US006048182A

United States Patent [19]

Hailes

[11] Patent Number: 6,048,182

[45] Date of Patent: Apr. 11, 2000

[54] HVLP SPRAY PAINTING METHOD AND APPARATUS

[76] Inventor: Ron Hailes, 866 Main Street East, Hamilton, ON, Canada, L8M 1L9

[21] Appl. No.: 08/990,985

[22] Filed: Dec. 15, 1997

Related U.S. Application Data

[60] Provisional application No. 60/033,376, Dec. 16, 1996.

[51] Int. Cl.[7] ..... F04B 17/03

[52] U.S. Cl. ..... 417/423.8; 417/423.14

[58] Field of Search ..... 417/423.8, 423.9, 417/423.14, 368, 199.2; 118/302

[56] References Cited

U.S. PATENT DOCUMENTS

| | | | |
|---|---|---|---|
| D. 365,569 | 12/1995 | Kieffer | D15/7 |
| 4,062,274 | 12/1977 | Knab | 454/65 |
| 4,762,472 | 8/1988 | King | 417/366 |
| 4,767,285 | 8/1988 | Jyoraku et al. | 417/366 |
| 4,854,822 | 8/1989 | Darroch | 417/62 |
| 4,929,262 | 5/1990 | Balon, Jr. et al. | 55/341.2 |
| 5,058,807 | 10/1991 | Smith | 239/302 |
| 5,074,467 | 12/1991 | Geberth | 239/8 |
| 5,240,181 | 8/1993 | Uribe | 239/135 |
| 5,265,801 | 11/1993 | Larson | 239/11 |
| 5,305,494 | 4/1994 | Candler | 15/304 |

*Primary Examiner*—Charles G. Freay
*Assistant Examiner*—David J. Torrente

[57] ABSTRACT

A high volume low pressure (hereinafter HVLP) blower having a blower motor with a cooling fan for passing cooling air over the blower motor and a blower turbine connected to and driven by the blower motor for delivering HVLP air to an air outlet. An air intake communicates fresh incoming air to the cooling fan and to the blower turbine. The HVLP blower has a blower housing having mounted therein the blower motor and blower turbine. The blower housing has exhaust vents therein for exhausting cooling air exhaust to the atmosphere. An exhaust plenum within the blower housing prevents mixing of the incoming air with the cooling air exhaust and provides a first passageway for cooling air exhaust to be communicated from the cooling fan to the exhaust vents, such that the exhaust vents direct the cooling air exhaust away from the air intake.

7 Claims, 7 Drawing Sheets

HVLP SPRAY PAINTING METHOD AND APPARATUS

CROSS REFERENCE TO RELATED APPLICATION

This Application claims priority from prior U.S. Provisional Application No.: 60/033,376 filed Dec. 16, 1996 by the same inventor.

FIELD OF THE INVENTION

This invention relates in general to high volume low pressure blowers and to high volume low pressure spray painting methods and apparatus.

BACKGROUND OF THE INVENTION

Conventional spray painting systems utilize relatively high pressure air (usually greater than 10 psi) to atomize paint in a spray gun. The atomized paint is transported to the surface to be painted however only a fraction of the paint is actually deposited. The transfer efficiency of atomized paint and volatile thinners actually deposited on the surface to be painted is of the order of 30–40%. The remaining relatively large amount of volatile chemical and paint is released to the atmosphere and is usually called over spray. Increased over spray reduces painting efficiency and increases paint costs and environmentally unfriendly discharges.

The State of California has, for instance, imposed strict regulations on spray painting for the purpose of curtailing the uncontrolled release of volatile chemicals into the atmosphere. These regulations require a transfer efficiency of at least 65% and in air spraying systems the use of air pressure less than ten pounds per square inch (psi). As a result a different approach has been taken with respect to the spray paint systems which are used. The so called high volume low pressure (hereinafter HVLP) spray painting systems have come into greater use in order to increase the transfer efficiency and decrease the over spray. The HVLP system utilizes a turbine to supply a high volume of low pressure air to a specially adapted spray gun.

Premature failure of HVLP blower motors due to insufficient cooling continues to be a problem. A blower motor which drives a blower turbine in an HVLP blower requires constant cooling in order to avoid overheating of the motor windings. To achieve the necessary cooling the blower motor has a cooling fan dedicated to continuously flowing cooling air over the motor.

Current HVLP blowers discharge the cooling air randomly back into the atmosphere or direct it into the turbine. The problem with discharging randomly back into the atmosphere is that hot cooling air exhaust is often sucked back into the cool air intake leading to overheating. Alternatively discharging the cooling air exhaust into the turbine is also not effective. When HVLP air is not required of the spray gun, back pressure develops interfering with the flow of cooling air over the blower motor.

The high transfer efficiency rate of the HVLP spraying painting system make them ideally suited for painting in confined spaces. They are being utilized in, for example, painting and refinishing of bathtubs and sinks in domestic and industrial installations. Nevertheless when spray painting in confined areas such as bathrooms proper ventilation and efficient removal of paint over spray continues to be a problem. The over spray releases volatile chemicals and solvents during spray painting and creates an unwanted odour which can easily spread throughout an entire building when painting bathtubs or refinishing sinks.

Accordingly, there is a need for an improved HVLP blower overcoming blower motor cooling problems. There is also a need for a spray painting system which minimizes over spray generation and preferably contains and/or controls the release of over spray fumes, volatile chemicals and solvents to a predetermined area.

SUMMARY OF THE INVENTION

In accordance with one aspect of the present invention A high volume low pressure (hereinafter HVLP) blower having a blower motor with a cooling fan for passing cooling air over the blower motor, a blower turbine connected to and driven by the blower motor for delivering HVLP air to an air outlet, and an air intake communicating fresh incoming air to the cooling fan and to the blower turbine, the HVLP blower comprises a blower housing having mounted therein the blower motor and blower turbine. The blower housing has exhaust vents therein for exhausting cooling air exhaust to the atmosphere; and an exhaust plenum within the blower housing to prevent mixing of the incoming air with the cooling air exhaust. The exhaust plenum also provides a first passageway for cooling air exhaust to be communicated from the cooling fan to the exhaust vents, such that the exhaust vents direct the cooling air exhaust away from the air intake.

Preferably the exhaust plenum houses the blower motor and blower turbine, and the exhaust plenum divides the incoming air flow into two streams through a second passageway and a third passageway such that fresh incoming air flows over the exhaust plenum and cools the exhaust plenum.

Preferably the exhaust plenum is a cubically shaped compartment within the blower housing, with the blower motor mounted to a top side adjacent a cooling air inlet defined in the top side, such that the cooling fan draws fresh incoming air into the motor through the cooling air inlet.

In accordance with another aspect a high volume low pressure (hereinafter HVLP) spray painting system has an HVLP blower with a blower motor with a cooling fan for passing cooling air over the motor, a blower turbine connected to and driven by the blower motor for delivering HVLP air to an air outlet It also has an air intake communicating incoming air to the cooling fan and blower turbine, the HVLP spraying system comprises a commercially available HVLP paint spray gun in communication with the air outlet and adapted to atomize liquid paint with HVLP air being received from the HVLP blower. An explosion resistant fame extractor adapted to extract over spray fumes from the spray gun. The fume extractor having a housing with an extractor inlet and extractor outlet, and having mounted therein an explosion resistant extractor motor connected to and driving an extractor fan which draws over spray fumes into the extractor inlet and discharges the over spray fumes out the extractor outlet, such that flammable gases passing through the extractor will not ignite.

Preferably the HVLP spray painting system further comprises a collapsible exhaust conduit having an extractor end releasably connected to the extractor outlet, and a discharge end for directing extracted over spray fumes to an exterior vent.

Preferably the HVLP blower further comprises a blower housing having mounted therein the blower motor and blower turbine, the blower housing having exhaust vents therein for exhausting cooling air exhaust to the atmosphere. HVLP blower also has an exhaust plenum within the blower housing for preventing mixing of the incoming air with the cooling air exhaust and providing a first passageway for cooling air exhaust to be communicated from the cooling fan to the exhaust vents, such that the exhaust vents direct the cooling air exhaust away from the air intake.

In accordance with another aspect of the present invention, a method of operating a high volume low pressure paint spraying system in a confined area having an HVLP blower, a blower motor with a cooling fan for passing cooling air over the motor, a blower turbine connected to and driven by the blower motor for delivering HVLP air to an air outlet, and an air intake communicating air to the cooling fan and blower turbine, a spray gun in communication with the air outlet and adapted to atomize liquid paint with HVLP air being received from the HVLP blower, an explosion resistant fume extractor for extracting over spray fumes, and a collapsible exhaust conduit for directing extracted over spray fumes to an exterior vent. The method comprising the steps of isolating the confined area by draping off internal air passageways, such as doorways, to the confined area. Spray painting in the confined area using a spray gun receiving HVLP air from the HVLP blower, positioned outside of the confined area and communicating HVLP air to the spray gun via an air hose. Extracting over spray fumes with the explosion resistant fume extractor. Directing the over spray fumes to an exterior vent such as a window via a collapsible exhaust conduit.

BRIEF DESCRIPTION OF THE DRAWINGS

The invention will now be described by way of example only, with references to the following drawings in which.

DETAILED DESCRIPTION OF THE PREFERRED EMBODIMENT

Figure 1:
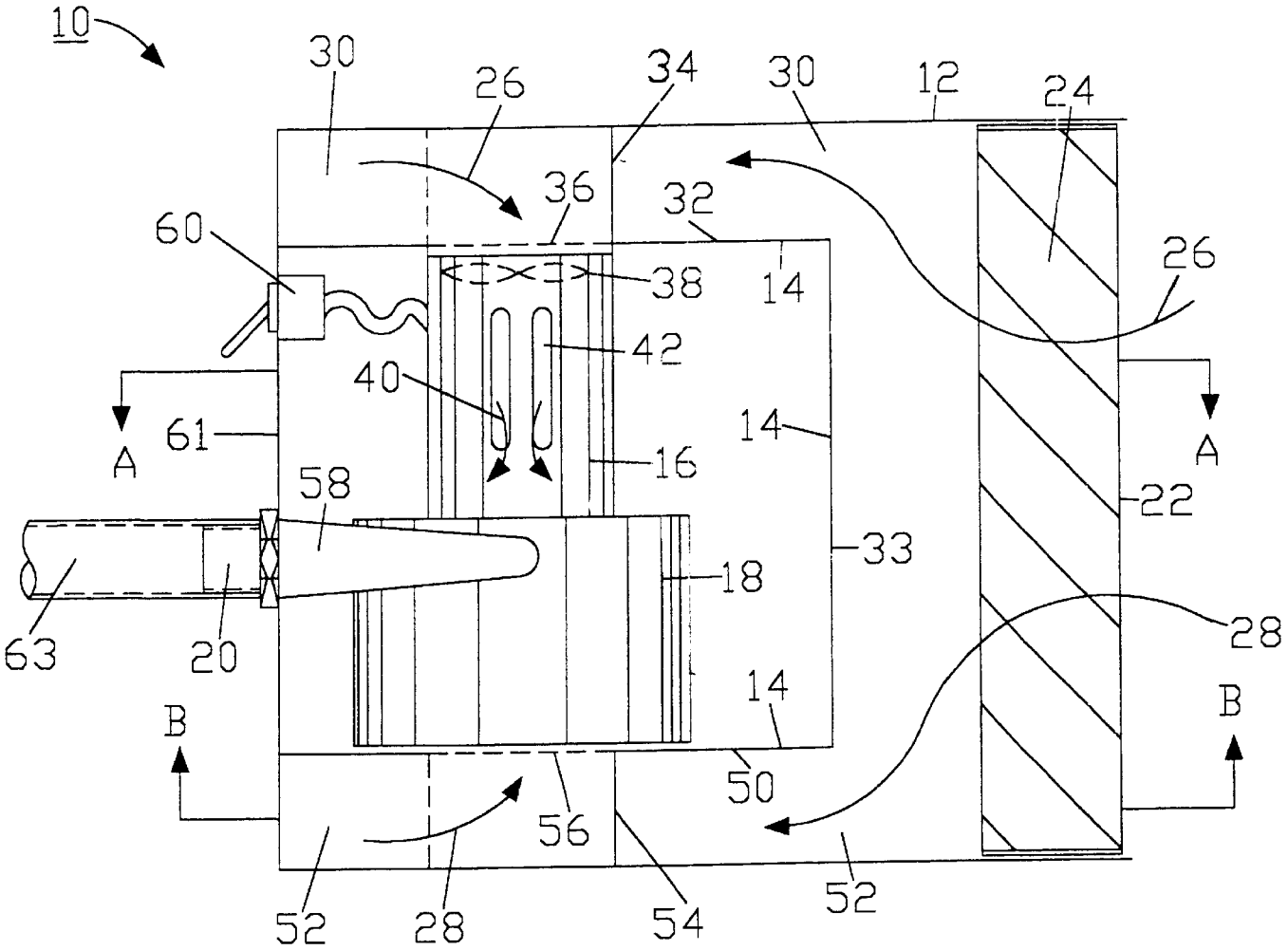
FIG. 1 is a schematic cross sectional side elevational view of the high volume low pressure blower.
Figure 5:
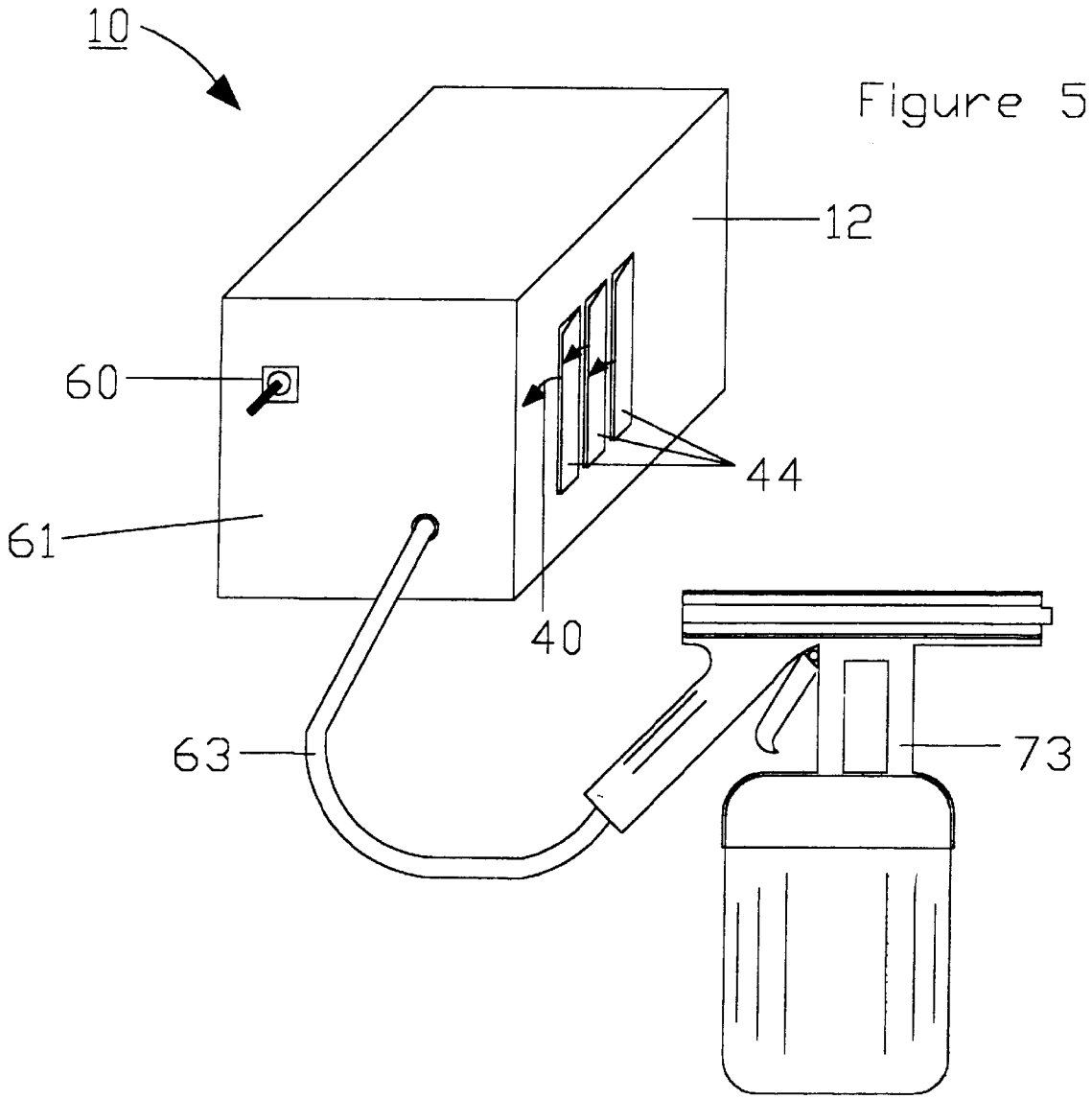
FIG. 5 is a perspective schematic front elevational view of the HVLP blower.

Referring to FIGS. 1 & 5 a preferred embodiment of the present invention, a high volume low pressure (hereinafter HVLP) blower shown generally as 10, the HVLP blower comprises a blower housing 12 having mounted therein a cooling air exhaust plenum 14 having mounted therein a blower motor 16 connected to and driving a blower turbine 18 having an HVLP air outlet 20.

The high volume low pressure blower comprises an air intake 22 wherein fresh air enters and passes through air filter 24. Exhaust plenum 14 divides the incoming air into two streams along cooling air flow paths 26 and HVLP air flow path 28. Air travelling along cooling air flow path 26 enters second passageway 30 which directs the air along a back side 33 and top side 32 of exhaust plenum 14, around cooling air baffle 34 and through cooling air inlet 36. Motor cooling fan 38 draws fresh cooling air in through cooling air inlet 36 and passes cooling air over blower motor 16 and out through motor vents 42 and into exhaust plenum 14. Cooling air exhaust 40 passes through exhaust plenum 14 and is discharged into the atmosphere through exhaust vents 44 in blower housing 12.

Incoming air travelling along HVLP air flow path 28 enters third passageway 52 which directs the incoming air along back side 33 and bottom side 50 of exhaust plenum 14 and around turbine inlet baffle 54 and through turbine inlet 56. Blower motor 16 is connected to and drives blower turbine 18 which draws incoming air into turbine inlet 56 and expels high volume low pressure air via outlet manifold 58 and out through HVLP air outlet 20. Air hose 63 transmits HVLP air to an HVLP air spray gun (not shown) for atomizing of liquid paint. Air hose 63 is preferably releasably connected to air outlet 20 with a quick connect fitting but may also be any other coupling means known. Electrical blower motor 16 is turned on and off via electrical switch 60 mounted on outlet panel 61.

Figure 2:
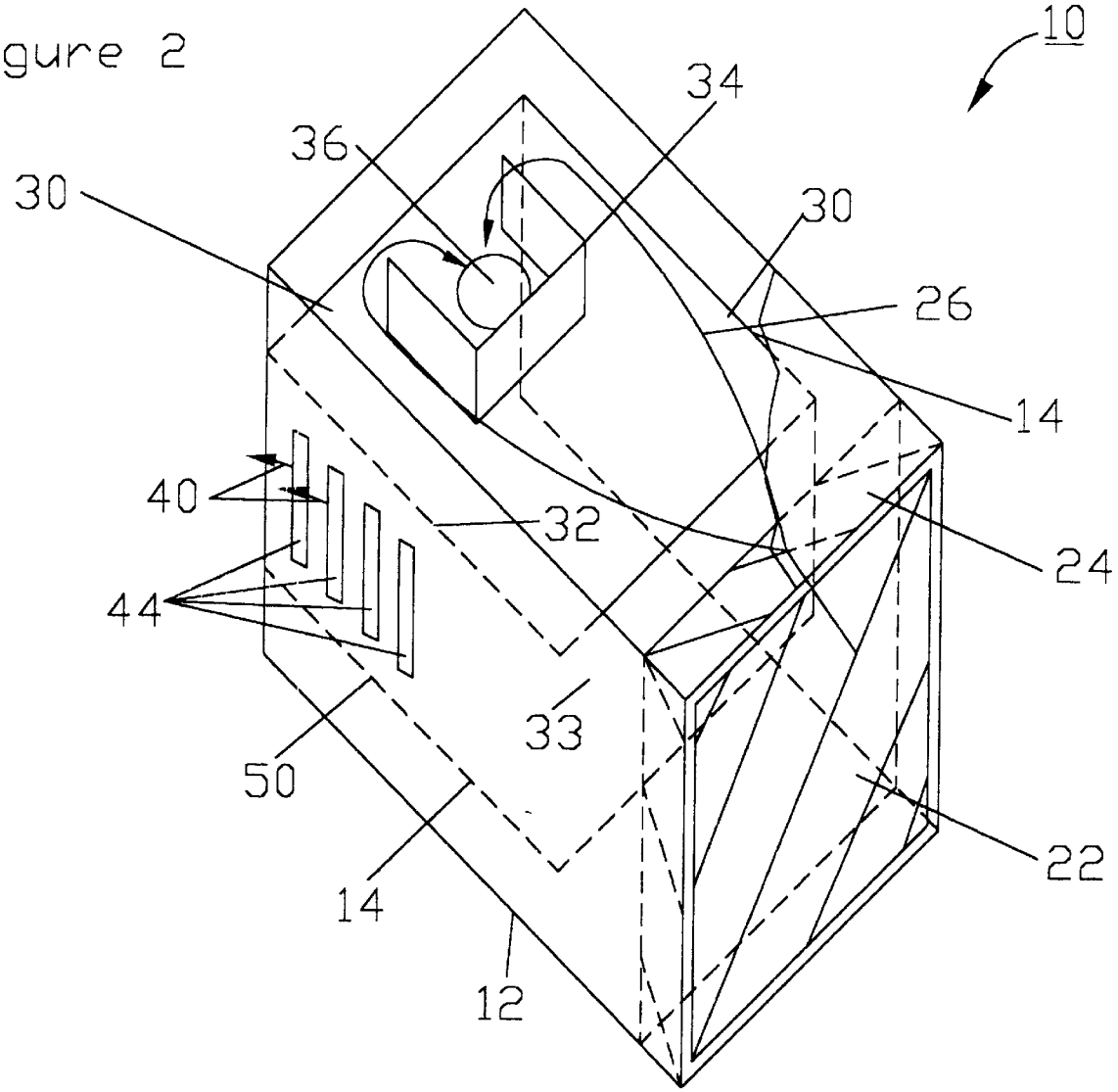
FIG. 2 is a schematic perspective top partial cutaway view of the HVLP blower.

Referring now to FIG. 2 showing a top partial cutaway view of blower housing 12, HVLP blower 10 comprises exhaust plenum 14, cooling air baffle 34, second passageway 30, and cooling air inlet 36. Exhaust plenum 14 directs incoming air flow path 26 through second passageway 30, around cooling air baffle 34 and into cooling air inlet 36. The incoming air also passes over back side 33 and top side 32 of exhaust plenum 33 thereby cooling exhaust plenum 14. Large rectangular air filter 24 is mounted onto air intake 22 of blower housing 12. Cooling air exhaust 40 is expelled via exhaust vents 44 which direct the flow of cooling air exhaust away from air intake 22.

Figure 3:
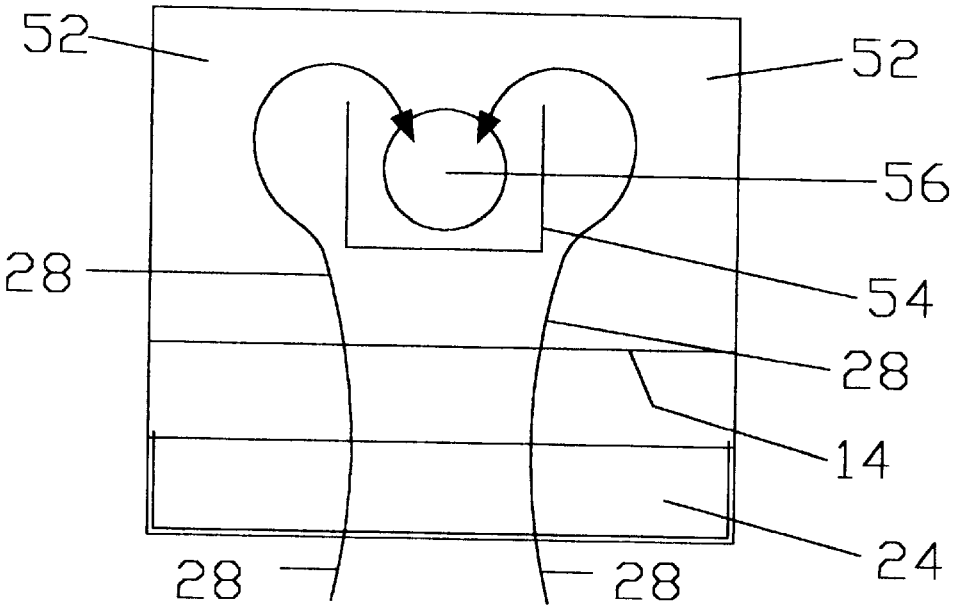
FIG. 3 is a schematic cross sectional view taken through section (B—B) in FIG. 1.

Referring now to FIG. 3 one can see that exhaust plenum 14, turbine inlet baffle 54, and turbine inlet 56, creates third passageway 52 which directs air along HVLP air flow path 28. HVLP air flow path 28 is dimensionally similar to cooling air flow path 26 except the air moves along a bottom side 50 of exhaust plenum 14.

Figure 4:
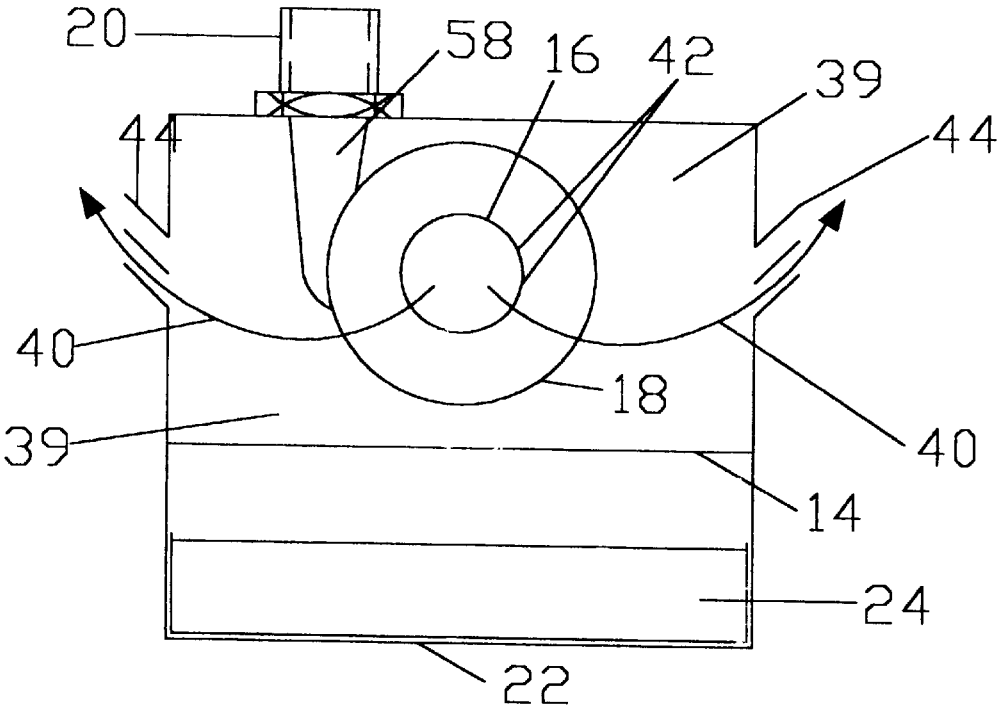
FIG. 4 is a schematic cross sectional view taken through section (A—A) in FIG. 1.

Referring to FIG. 4, which is a horizontal cross section taken through A—A in FIG. 1, the HVLP blower 10 comprises blower turbine 18 connected to and driven by blower motor 16 having motor vents 42 discharging cooling air exhaust 40 through a first passage way 39 defined by exhaust plenum 14 and out through exhaust vents 44 which direct the cooling air exhaust 40 away from air intake 22.

Figure 6:
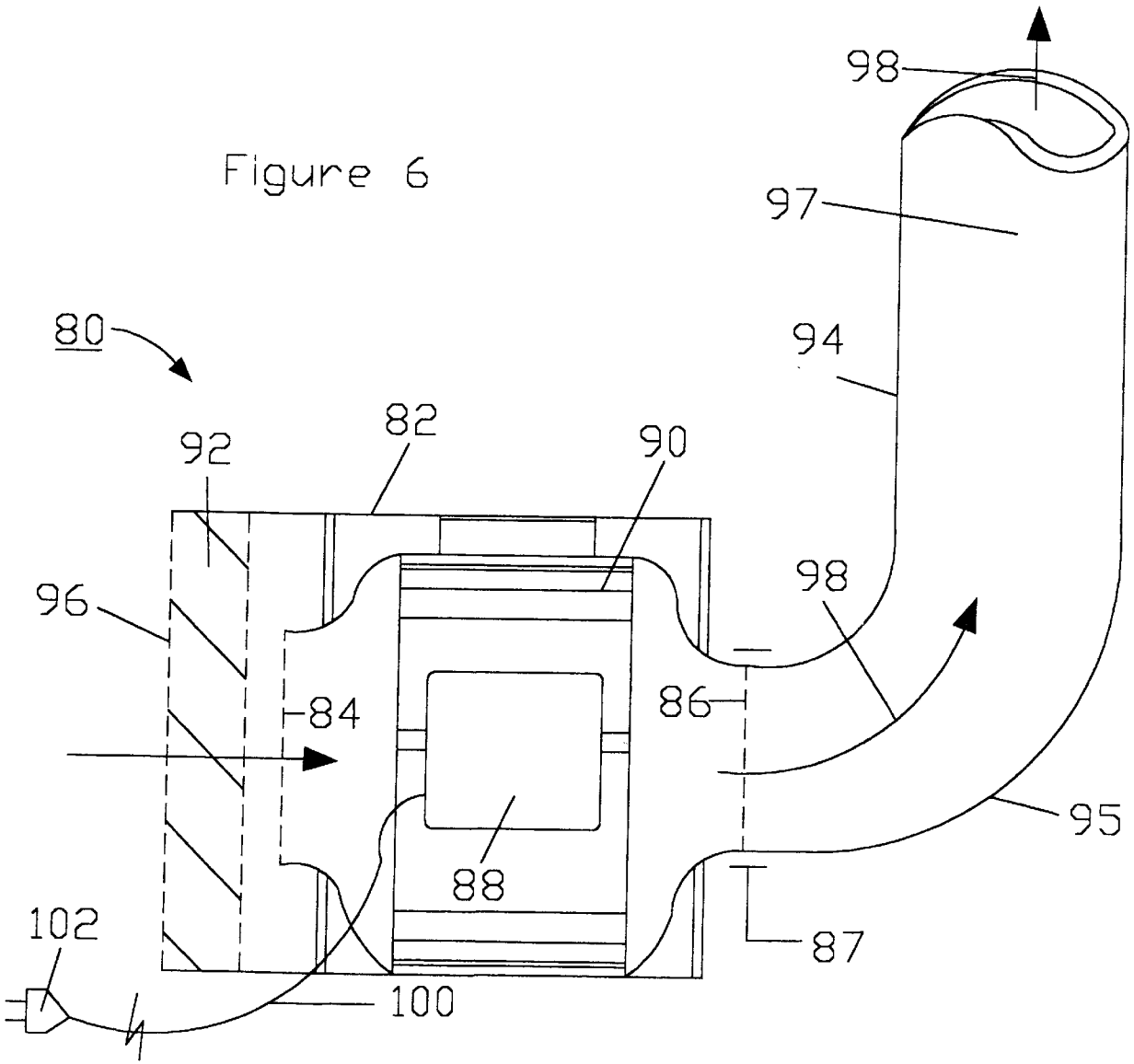
FIG. 6 is a side elevational cross sectional view of explosion resistant fume extractor.
Figure 7:
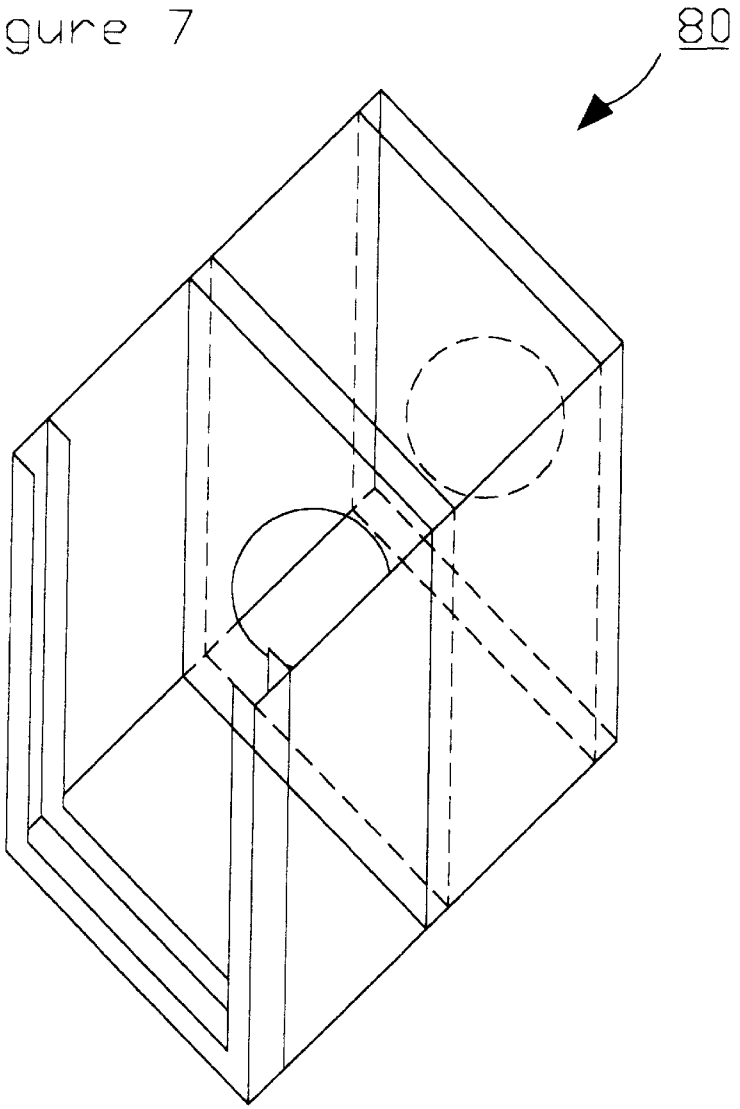
FIG. 7 is a perspective view of the explosion resistant fume extractor housing.

FIGS. 6 and 7 illustrates a preferred embodiment of an explosion resistant fume extractor shown generally as 80 which when used in conjunction with HVLP blower 10 forms a high volume low pressure spray painting system. Fume extractor 80 comprises extractor housing 82, extractor inlet 84, extractor outlet 86, and collapsable exhaust conduit 94. Mounted within extractor housing 82 is an explosion resistant extractor motor 88 which is connected to and drives extractor fan 90.

Located at extractor inlet end 96 is an extractor filter 92 for filtering air drawn into extractor inlet 84. Extractor end 95 of exhaust conduit 94 is releasably connected to extractor outlet 86 preferably with band clamp 87. Exhaust conduit 94 is a collapsable hollow pipe which directs the flow of extractor exhaust 98 and discharges it at discharge end 97. Electrical cord 100 supplies electrical power to motor 88 when plug 102 is inserted in a conventional electrical outlet. Extractor motor 88 is of the design which emits little or no sparks which could ignite a flammable gas mixture passing through fume extractor 80. Collapsible conduit 94 when extended is long enough to reach an exterior venting location (approximately 15' to 25' in length when extended) and can be collapsed to a length less than two feet in length for easy transport.

In use, HVLP blower 10 supplies HVLP air to any conventional HVLP paint spraying gun 73 via hose 63 connecting HVLP air outlet 20 to the spray painting gun.

HVLP blower 10 draws fresh air in through air intake 22 and air filter 24. Fresh incoming air is divided into two streams, cooling air flow path 26 through second passageway 30 and HVLP air flow path 28 through third passageway 52. Incoming air passing through second passageway 30 supplies fresh air to motor cooling fan 38. Incoming air passing through third passageway 52 supplies fresh air to blower turbine 18. Incoming fresh air passing through second and third passageways 30 & 52 also contacts the back, top and bottom sides 33, 32, & 50 of exhaust plenum 14 cooling the exhaust plenum 14. This helps to keep motor 16 cool. Cooling air exhaust 40 which cools blower motor 16 is exhausted through exhaust plenum 14 and exhaust vents 44 which direct the hot cooling air exhaust 40 away from air intake 22 of HVLP blower 10. This arrangement minimizes hot cooling air exhaust 40 from being drawn into air intake 22 ensuring that cool air is drawn into air intake 22 preventing blower motor 16 from overheating.

For example; painting a bathtub in a confined area such as a small washroom can create a considerable volume of over spray fumes. These fumes need to be extracted from the room in order to; minimize inhalation of over spray fumes, minimize the spread of the fumes to the rest of the building, and to minimize their explosion potential. In order to achieve the above, HVLP blower 10 is used in conjunction with explosion resistant fume extractor 80. HVLP blower 10 is located somewhere exterior to the room in which the spray painting is taking place and explosion resistant fume extractor 80 is placed within the room where the painting is occurring. HVLP blower 10 supplies HVLP air to a HVLP spray gun via a long air hose 63 which is long enough to reach the object being painted. During spray painting explosion resistant fume extractor 80 draws in over spray fumes into extractor inlet 84 and through extractor filter 92 which filters out any particulate matter from the over spray and then discharges the over spray fumes via extractor exhaust 98 and out through long collapsable exhaust conduit 94 which can direct extractor exhaust 98 to an open window somewhere within the building. Since fume extractor 80 utilizes an explosion resistant extractor motor 88 there is little possibility that the over spray fumes, which are highly volatile, can explode or burst into flames.

Figure 8:
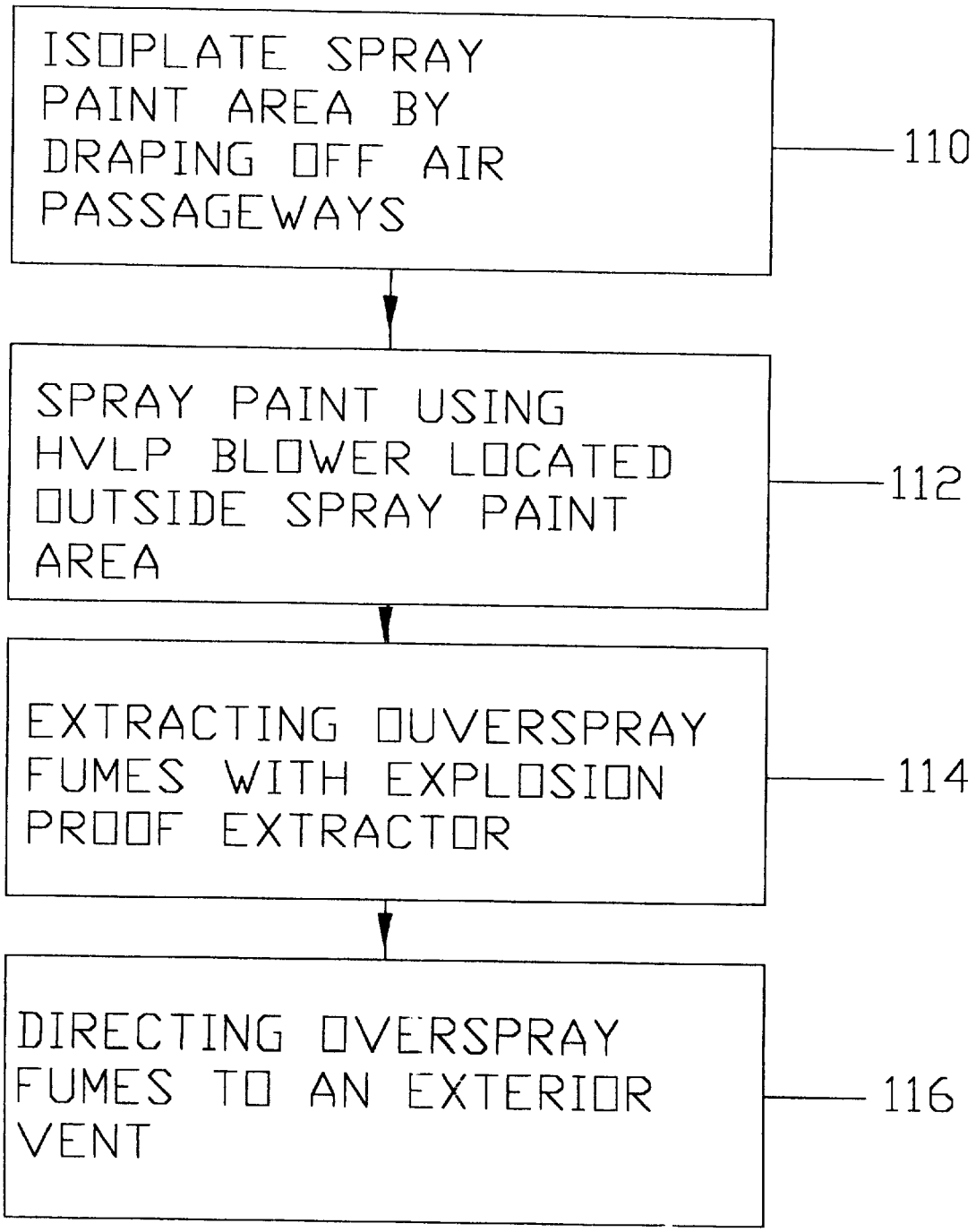
FIG. 8 is a flow diagram showing the preferred method of use of the HVLP spray painting system.

Referring now to FIG. 8, following steps 110 to 116 is the preferred method of spray painting in confined areas using HVLP blower 10 with explosion resistant fume extractor 80 having a collapsable exhaust conduit 94. Firstly step 110, the area or room where the painting is to take place is isolated by draping off any air passageways which lead into the room. For example, doorways leading into the room will be draped off using either plastic and/or cloth materials in order to minimize air movement through the doorway. Secondly step 112, spray painting is carried out using HVLP blower 10 with any conventional spray gun which is capable of atomizing paint using HVLP air in the conventional manner. HVLP blower 10 is positioned outside of the area in which the painting takes place in order to minimize the explosion potential. Air hose 63 is long enough to supply HVLP air from HVLP blower positioned outside the room to the HVLP spray gun 73 inside the room. Thirdly step 114, any over spray which is generated by the spray painting process is extracted via explosion resistant fume extractor 80 which extracts the over spray fumes out through collapsable exhaust conduit 94. Finally step 116, collapsable exhaust conduit 94 directs over spray fumes to an exterior vent such as an open window preferably in an adjacent room so as not to interfere with the spray painting process. By following this procedure, the over spray fumes are confined to the room in which the painting is taking place and are quickly exhausted to the outside. This method creates a slight negative pressure in the room in which spray painting takes place thereby minimizing the transport of over spray fumes into the remainder of the building. The danger of explosion or fire breaking out is also minimized by using an explosion resistant fame extractor and by rapidly removing any over spray within the room to the exterior of the building thereby preventing the buildup of explosive gases.

It should be apparent to persons skilled in the art that various modifications and adaptations of the structure described above are possible without departure from the spirit of the invention the scope of which is defined in the appended claims.

I claim:

1. A high volume low pressure (hereinafter HVLP) blower having a blower motor with a cooling fan for passing cooling air over the blower motor, a blower turbine connected to and driven by the blower motor for delivering HVLP air to an air outlet, and an air intake communicating fresh incoming air to the cooling fan and to the blower turbine, the HVLP blower comprising:

a) a blower housing having mounted therein the blower motor and blower turbine, the blower housing having exhaust vents therein for exhausting cooling air exhaust to the atmosphere; and b) an exhaust plenum within the blower housing for preventing mixing of the incoming air with the cooling air exhaust and providing a first passageway for cooling air exhaust to be communicated from the cooling fan to the exhaust vents, such that the exhaust vents direct the cooling air exhaust away from the air intake, c) wherein the exhaust plenum houses the blower motor and blower turbine and the exhaust plenum divides the incoming air flow into two streams, the incoming air flowing through a second passageway and a third passageway such that fresh incoming air flows over a portion of the exhaust plenum and cools the exhaust plenum, d) wherein the exhaust plenum has a top side and a bottom side with the blower motor mounted to a top side adjacent a cooling air inlet defined in the top side, such that the cooling fan draws fresh incoming air into the motor through the cooling air inlet, e) wherein the blower turbine is mounted to a bottom side of the exhaust plenum and adjacent a turbine inlet such that the blower turbine draws fresh incoming air into the blower turbine through the blower turbine inlet;

f) wherein the exhaust plenum further comprises:

i) a U shaped cooling air baffle rigidly attached to the top side proximate the cooling air inlet for directing tie flow of air in the second passageway defining an indirect flow path to the cooling air inlet such that the contact of fresh incoming air with the top side of the exhaust plenum is maximized; and ii) a U shaped turbine inlet baffle rigidly attached to the bottom side proximate the turbine inlet for directing the flow of air in the third passageway defining an indirect flow path to the turbine inlet such that the contact of fresh incoming air with the bottom side of the exhaust plenum is maximized.

2. The HVLP blower claimed in claim 1 wherein the blower housing further comprises an outlet panel having an electrical switch mounted thereon for turning the blower motor on and off and a HVLP air hose connected to the air outlet for the supply of HVLP to a remote location.

3. The HVLP blower claimed in claim 1 wherein the HVLP blower further comprises an air filter mounted at the air intake for filtering fresh incoming air passing through the air intake.

4. The HVLP blower claimed in claim 2 wherein the exhaust vents direct the cooling air exhaust away from the air intake such that the cooling air exhaust does not get sucked into the air intake thereby ensuring that the incoming air remains as cool as possible.

5. A high volume low pressure (hereinafter HVLP) spray painting system having an HVLP blower with a blower motor with a cooling fan for passing cooling air over the motor, a blower turbine connected to and driven by the blower motor for delivering HVLP air to an air outlet, and an air intake communicating incoming air to the cooling fan and blower turbine, the HVLP spraying system comprises:

a) a blower housing having mounted therein the blower motor and blower turbine, the blower housing having exhaust vents therein for exhausting cooling air exhaust to the atmosphere;

b) an exhaust plenum within the blower housing for preventing mixing of the incoming air with the cooling air exhaust and providing a first passageway for cooling air exhaust to be communicated from the cooling fan to the exhaust vents, such that the exhaust vents direct the cooling air exhaust away from the air intake, c) wherein the exhaust plenum houses the blower motor and blower turbine and the exhaust plenum divides the incoming air flow into two streams, the incoming air flowing through a second passageway and a third passageway such that fresh incoming air flows over a portion of the exhaust plenum and cools the exhaust plenum, d) wherein the exhaust plenum has a top side and a bottom side with the blower motor mounted to a top side adjacent a cooling air inlet defined in the top side, such that the cooling fan draws fresh incoming air into the motor through the cooling air inlet, e) wherein the blower turbine is mounted to a bottom side of the exhaust plenum and adjacent a turbine inlet such that the blower turbine draws fresh incoming air into the blower turbine through the blower turbine inlet;

f) wherein the exhaust plenum further comprises:

i) a U shaped cooling air baffle rigidly attached to the top side proximate the cooling air inlet for directing the flow of air in the second passageway defining an indirect flow path to the cooling air inlet such that the contact of fresh incoming air with the top side of the exhaust plenum is maximized; and ii) a U shaped turbine inlet baffle rigidly attached to the bottom side proximate the turbine inlet for directing the flow of air in the third passageway defining an indirect flow path to the turbine inlet such that the contact of fresh incoming, a commercially available HVLP paint spray gun in communication with the air outlet and adapted to atomize liquid paint with HVLP air being received from the HVLP blower; and h) an explosion resistant fume extractor adapted to extract over spray fumes from the spray gun, the fume extractor having a housing with an extractor inlet and extractor outlet, and having mounted therein an explosion resistant extractor motor connected to and driving an extractor fan which draws over spray fumes into the extractor inlet and discharges the over spray fumes out the extractor outlet, such that flammable gases passing through the extractor have little opportunity to ignite.

6. The HVLP spray painting system claimed in claim 5, further comprising a collapsible exhaust conduit having an extractor end releasably connected to the extractor outlet, and a discharge end for directing extracted over spray fumes to an exterior vent.

7. The HVLP spray painting system claimed in claim 5, wherein the exhaust vents direct the cooling air exhaust away from the air intake such that the cooling air exhaust does not get sucked into the air intake thereby ensuring that the incoming air remains as cool as possible.

* * * * *